US009714525B2

(12) United States Patent
Eller et al.

(10) Patent No.: US 9,714,525 B2
(45) Date of Patent: Jul. 25, 2017

(54) ANTI-LIGATURE HANDLE AND ESCUTCHEON FOR OPERATING A LOCK

(71) Applicant: Sargent Manufacturing Company, New Haven, CT (US)

(72) Inventors: Darren C. Eller, East Lyme, CT (US); Ryan Piantek, Middletown, CT (US); Dan Riley, Easton, CT (US); Andrew Geraci, Branford, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 197 days.

(21) Appl. No.: 14/402,199

(22) PCT Filed: Jun. 5, 2013

(86) PCT No.: PCT/US2013/044275

§ 371 (c)(1),
(2) Date: Nov. 19, 2014

(87) PCT Pub. No.: WO2013/184773

PCT Pub. Date: Dec. 12, 2013

(65) Prior Publication Data

US 2015/0130197 A1 May 14, 2015

Related U.S. Application Data

(60) Provisional application No. 61/655,795, filed on Jun. 5, 2012.

(51) Int. Cl.
*E05B 3/00* (2006.01)
*E05B 1/00* (2006.01)
(Continued)

(52) U.S. Cl.
CPC ..... *E05B 1/003* (2013.01); *E05B 1/00* (2013.01); *E05B 5/00* (2013.01); *E05B 65/0032* (2013.01); *Y10T 292/57* (2015.04)

(58) Field of Classification Search
CPC ... Y10T 292/57; Y10T 292/82; Y10T 292/85; Y10T 292/873; Y10T 292/91;
(Continued)

(56) References Cited

U.S. PATENT DOCUMENTS 266,947 A 10/1882 Marks
352,213 A * 11/1886 White ..... E05B 65/0811 292/134
(Continued)

FOREIGN PATENT DOCUMENTS

BE 1008810 8/1996
DE 10053062 5/2002
(Continued)

*Primary Examiner* — Alyson M Merlino
(74) *Attorney, Agent, or Firm* — DeLio, Peterson & Curcio, LLC; David R. Pegnataro

(57) ABSTRACT

An anti-ligature handle and escutcheon for operating a lock. The handle and escutcheon are smoothly curved in all directions to eliminate hanging points and prevent suicide by preventing the attachment of a ligature to the handle or escutcheon. The handle is curved to allow fingers to be inserted behind the handle to pull on the handle. The handle is attached to a handle plate that slides behind an escutcheon plate portion of the escutcheon. Multiple ligature traps in the form of an inverted "V" are positioned in parallel offset rows between the handle plate and the escutcheon plate to prevent the insertion of a ligature around the handle and handle plate.

21 Claims, 8 Drawing Sheets

(51) Int. Cl.
*E05B 65/00* (2006.01)
*E05B 5/00* (2006.01)

(58) Field of Classification Search
CPC ... Y10T 16/458; Y10T 16/46; Y10T 16/4636; Y10T 16/464; Y10T 16/476; Y10S 292/65; Y10S 292/56; Y10S 292/57; Y10S 292/58; E05B 1/00; E05B 1/0007; E05B 1/003; E05B 1/04; E05B 65/00; E05B 65/0017; E05B 65/0032; E05B 5/00
USPC ..... 70/91, 95–100, 207–210, 224
See application file for complete search history.

(56) References Cited

U.S. PATENT DOCUMENTS 469,863 A 3/1892 Zerfas
609,422 A 8/1898 Fackner
633,291 A * 9/1899 Newell ..... E05B 65/0811 70/154
646,233 A * 3/1900 Newell ..... E05B 65/0811 16/429
975,037 A 11/1910 Hettwer
1,090,305 A * 3/1914 Hoffman ..... E05B 65/0864 292/333
1,326,450 A 12/1919 Howard et al.
1,434,370 A 11/1922 Crompton et al.
1,738,387 A 3/1929 Niessen et al.
D114,315 S 4/1939 Brodbeck
2,304,145 A 12/1942 Borchers
2,321,724 A 6/1943 Aldeen et al.
D145,210 S 7/1946 Fisk
2,531,670 A 11/1950 Cain
2,581,606 A 1/1952 David et al.
2,755,120 A 7/1956 Young et al.
2,813,737 A 11/1957 Reiter
3,038,757 A 6/1962 Schulze
3,713,683 A 1/1973 Neary
3,792,887 A 2/1974 Ramsey
4,064,721 A 12/1977 Morgan
D267,194 S 12/1982 Baker
4,404,709 A 9/1983 Janz et al.
4,492,394 A 1/1985 Dignan
4,575,141 A 3/1986 Burns
5,303,965 A * 4/1994 Meehan ..... E05B 1/003 16/DIG. 24
5,348,355 A * 9/1994 Oyha ..... E05B 83/16 292/11
5,797,286 A 8/1998 Armstrong
5,918,916 A 7/1999 Kajuch
6,135,512 A 10/2000 Galvin
6,460,906 B2 10/2002 Bingle et al.
7,373,694 B1 5/2008 Kopp
7,617,707 B2 11/2009 Chiang
7,802,828 B2 9/2010 Hopkins et al.
8,052,182 B1 11/2011 Weinerman et al.
8,122,745 B2 2/2012 Ramsauer et al.
D680,849 S * 4/2013 Berger ..... D8/308
D690,577 S * 10/2013 Eller ..... D8/331
9,033,375 B1 * 5/2015 Moon ..... E05B 1/003 292/140
2003/0135956 A1 7/2003 Gunthardt
2003/0150247 A1 8/2003 Talpe
2006/0220398 A1 10/2006 Ruano
2010/0013248 A1 1/2010 Keller
2010/0072762 A1 3/2010 Marks
2010/0126239 A1 5/2010 Berger
2010/0327611 A1 12/2010 Rees
2011/0068927 A1 3/2011 Berger
2011/0120024 A1 5/2011 Shilts
2011/0174026 A1 7/2011 Salvatore et al.
2013/0270844 A1 * 10/2013 Berger ..... E05B 1/003 292/336.3
2014/0311194 A1 * 10/2014 Berger ..... E05B 1/003 70/101

FOREIGN PATENT DOCUMENTS

EP 1927709 6/2008
GB 718113 11/1954
GB 2276659 10/1994
GB 2413068 10/2005
GB 2459884 11/2009
JP 1970021044 8/1970
JP 000492398 1/1979
JP 05240972 A 9/1993
JP 000895580 4/1994
JP 2004162401 6/2004
JP 2004324250 11/2004
JP 0003137332 10/2007
WO WO 2010092398 8/2010

* cited by examiner

ANTI-LIGATURE HANDLE AND ESCUTCHEON FOR OPERATING A LOCK

FIELD OF THE INVENTION

This invention relates to anti-ligature locks and door handles designed to prevent suicide by preventing the attachment of a ligature to the door handle or the lock mechanism.

DESCRIPTION OF RELATED ART

Buildings such as hospitals, mental health facilities, prisons, detention centers and the like are locations where patients, inmates and detainees are subject to stress and high levels of emotion. Under such circumstances, there is an increased risk of suicide by those within. Such events may be referred to as "sentinel events."

A common type of attempted suicide or self-harm is by hanging or strangulation by attaching a ligature, such as clothing or a belt to a conventional door knob or lever handle. Because it is not possible for all patients and inmates to be continuously monitored, public buildings of the aforementioned type are increasingly being provided with specially designed anti-ligature locks and door handles. The use of such anti-ligature locks and handles can significantly reduce or eliminate the occurrence of sentinel events, i.e., suicide and/or self-inflicted injuries.

A conventional knob or lever handle allows clothing or a belt to be attached to the handle of the lock mechanism. Anti-ligature locks and door handles function by eliminating projections and hanging points, which prevents clothing or belts from being attached to the handle.

However, by eliminating such projections conventional anti-ligature handles are often difficult to grasp and operate. This is a particular problem in hospitals where the elderly, those with infirmities and/or those with limited use of their hands must be able to operate the door. There is a need for an anti ligature lock having a handle design that is as easily operated as a lever handle.

Many attempted suicides involve the use of clothing or a belt as a ligature, However, even where an anti-ligature handle has been installed, a patient intent on self-harm may attempt to insert a small diameter ligature, such as dental floss or thread, into joints or spaces between moving handle components.

Such joints would not normally provide a hanging point for clothing, belts or ropes. However, when multiple threads or lengths of dental floss are combined, it may still be possible for a conventionally designed anti-ligature lock or door handle to provide a hanging point. There is a need for an anti ligature lock handle design that prevents small diameter ligatures from being inserted into gaps, spaces or joints in the handle to eliminate all hanging points for such small diameter ligatures.

Another problem with conventional anti ligature lock handles is that they do not have an attractive appearance. There is a need for an anti ligature lock handle design that is attractive and provides a modem appearance.

SUMMARY OF THE INVENTION

The present invention provides a handle design that is both attractively modem in appearance and which effectively prevents the handle from providing a hanging point for suicide attempts. The handle is designed such that ligatures of large and small diameter slide off the outer surface of the handle to foreclose use as a hanging point.

In a preferred aspect of the invention, the design of the handle is such that when small diameter ligatures, such as dental floss are inserted into joints in an attempt to attach to the door handle, the ligature is either directly prevented from passing through the joint by closing the gap entirely, or the end of the ligature is guided into a dead end to prevent it from passing through the gap.

This is achieved in one aspect of the invention by providing a handle plate parallel to the surface of the door on which the handle is mounted. The handle plate is connected to the handle and slides behind an escutcheon plate, such that it is not possible to insert a ligature behind the handle without passing it upwards from the handle between the escutcheon plate and the handle plate. The handle plate has a smooth appearance that is exposed as the handle pivots down to open the door. The inner surface of the escutcheon plate has multiple inverted "ligature traps," preferably in the form of inverted "V" shapes or "U" shapes. The inverted ligature traps prevent a small diameter ligature from passing upwards between the handle plate and the escutcheon plate. This prevents passing a small diameter ligature around the handle.

The ligature traps are fanned as small ridges set in offset rows and have a low height such that the V-shaped surface rides against the moving handle plate with very little space between the handle plate and the repeated surfaces of the ligature traps. The ligature traps are preferably formed of a low friction plastic.

The handle plate is securely attached to the back of the handle or formed integral therewith such that it is not possible for a small diameter ligature to pass between the handle and the handle plate. If an attempt is made to pass a small diameter ligature behind the handle, the handle plate forces the ligature upwards behind the escutcheon plate in the area above the handle.

The ligature traps are fanned on the side of the escutcheon plate that faces the door. Preferably, the back side of the escutcheon plate is provided with a molded anti-friction plastic liner attached to the escutcheon plate, between the escutcheon plate and the handle plate. The anti-friction plastic liner for the escutcheon plate contacts the moving handle plate.

The ligature traps are preferably in the form of low-height, inverted, V-shaped ridges. Inverted U-shaped ridges or similar dead end shapes may also be used. The legs of the U or V-shape guide the ligature into the dead end when a ligature is inserted from below to prevent it from passing any further upwards.

The V-shape acts as a dead end only from below. When seen from above, the inverted V or U-shape acts to guide debris to the gaps between each element and thus out of the lock mechanism. To prevent a ligature from passing through the gaps between adjacent ligature traps, multiple offset rows of ligature traps are provided.

If a ligature passes upwards between two adjacent ligature trap elements of a lower row of traps, it will immediately enter a dead end ligature trap in the offset row above. Thus, no matter where the ligature is inserted, it reaches a dead end.

The anti-ligature handle is pivoted at one end similar to a lever handle to allow for easy operation. The shape of the anti-ligature handle is smoothly curved in such a way that a user may place fingers behind the upper edge of the handle and between the upper edge of the handle and the handle plate, but without providing any opening behind the handle. This allows a pulling force to be easily applied to the door.

In the preferred design, the escutcheon completely surrounds the handle. The escutcheon provides a recessed area where the handle pivots. The recessed area is preferably triangular in shape. The handle plate preferably extends underneath the escutcheon in the area above the handle and extends beyond at least the moving end of the handle. As the handle is rotated down to open the door, the handle plate is exposed from beneath the escutcheon above the handle, while the handle plate at the moving end of the handle passes underneath a lower edge of the surrounding escutcheon plate.

This functions to prevent a small diameter ligature from passing behind the lower end of the handle or behind the handle plate. In a more highly preferred aspect of the invention, the handle plate at the moving end of the handle includes a guide that slides within a guide track formed in the escutcheon along the moving end of the handle.

A preferred embodiment of the present invention will be described below in some detail, but those skilled in the art will understand from the principles described below how to apply the present invention to handle designs having different handle shapes and escutcheons than those described herein.

Bearing in mind the problems and deficiencies of the prior art, it is therefore an object of the present invention to provide an anti-ligature lock having a handle that moves within a triangular recess in an escutcheon where a handle plate extends beneath an escutcheon plate provided with ligature traps.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 9 is a front elevational view with an upper portion of the escutcheon cut away to show the escutcheon liner. The handle is in the upward position corresponding to a closed lock position with the latchbolt extended.

FIG. 10 is a front elevational view and has the right side of the escutcheon cut away to show more of the escutcheon liner that is behind the escutcheon plate and in front of the handle plate.

FIG. 11 is a back elevational view corresponding to FIG. 1 except that the backing plate, anti-friction handle liner and handle plate have all been removed to show the opposed surface of the escutcheon liner with the ligature traps formed on the surface thereof.

FIG. 12 is a front elevational view and has the upper portion of the escutcheon cut away. The escutcheon liner has not been cut away. The handle is partially operated as in FIG. 3. The edge of the handle liner with the raised guide ridge can be seen behind the escutcheon liner.

DESCRIPTION OF THE PREFERRED EMBODIMENT(S)

Figure 1:
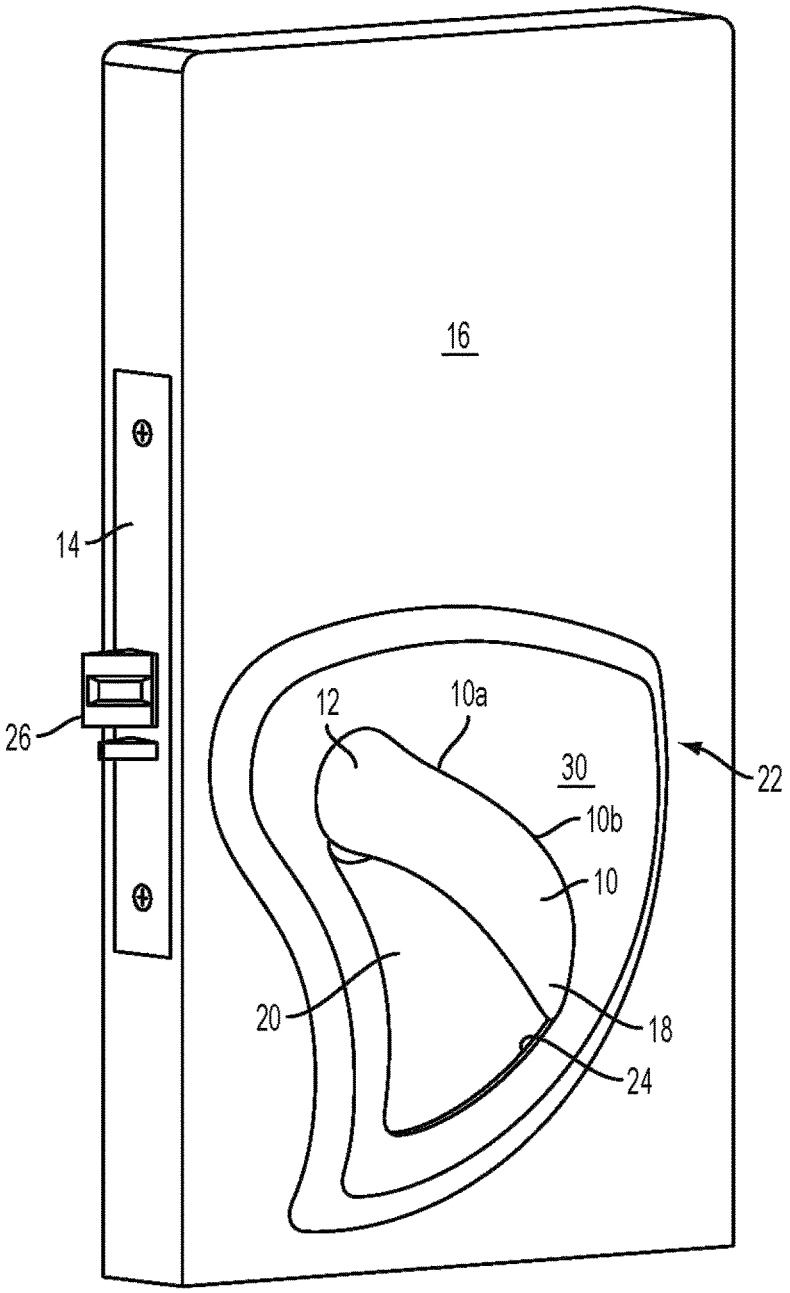
FIG. 1 is a perspective view showing an anti-ligature handle for a lock installed on a door. The door and a mortise lock are shown in phantom to indicate that various types of doors and locks may be used with the anti-ligature handle.

In describing the preferred embodiment of the present invention, reference will be made herein to FIGS. 1-13 of the drawings in which like numerals refer to like features of the invention.

FIGS. 1-7 provide external views of a preferred design for the anti-ligature handle and surrounding escutcheon of the present invention. A door and a mortise lock are shown in phantom lines to indicate that the handle and escutcheon may be used with various locks and door types.

Referring to FIGS. 1-7, the handle 10 rotates about an upper end 12 to operate lock mechanism 14 installed in door 16. A spindle not shown in FIGS. 1-7 extends from the upper end of the handle perpendicularly through the door and into operating engagement with the lock mechanism. The handle 10 includes a lower end 18.

The handle 10 rotates within an approximately triangular shaped recess 20 in an escutcheon 22 that surrounds the handle 10. The lower end 18 slides along an arcuate lower edge 24 of the recess 20 in the escutcheon 22.

As can be seen in FIGS. 1-7, the handle 10 is smoothly curved in all directions and provides no openings allowing a ligature to pass behind the handle. The curves of the handle and escutcheon shape are generally in a downwards direction such that no hanging points are provided and weight cannot be placed upon the handle. The escutcheon 22 is also smoothly curved and provides no projections or hanging points.

The handle 10 includes an upper edge marked at 10*a* and 10*b*. The user may reach beyond this upper edge and place fingertips behind and below this upper edge which allows the handle to be operated more easily. This shape also allows the user to reach behind the upper edge 10*a*, 10*b* of the handle and pull the handle towards the user which allows the handle to be used to pull the door 16 towards the user.

Figure 3:
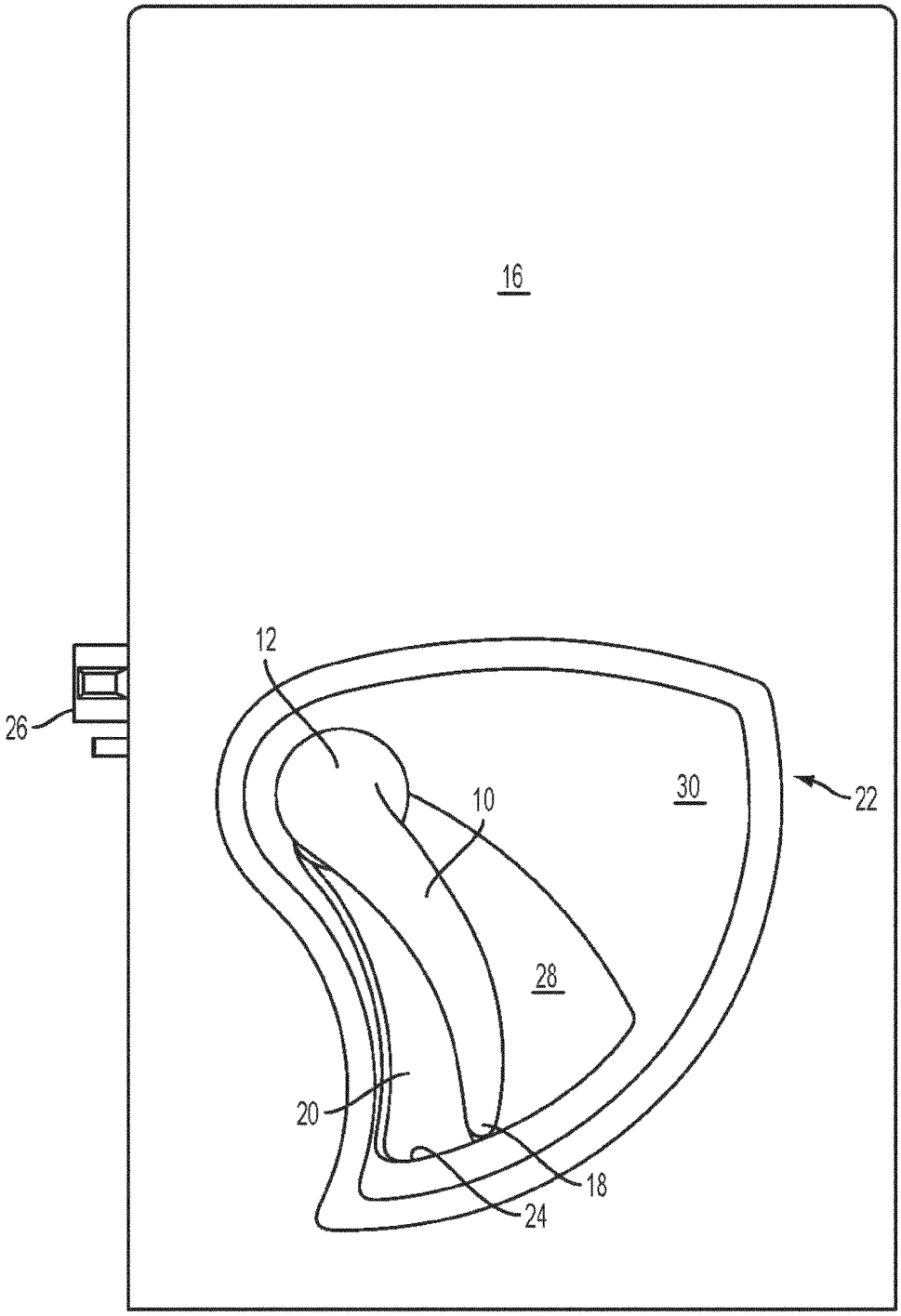
FIG. 3 is a front elevational view of the anti-ligature handle for a lock seen in FIG. 1 with the handle partially operated.

Referring to FIG. 3, as the handle 10 is rotated down, the lock mechanism 14 is operated to retract the latchbolt 26. As the handle 10 rotates down, a handle plate 28 rotates with it. The handle plate 28 is securely attached to the back of the handle 10 to prevent ligatures from being passed behind the handle 10. In FIG. 1, the handle plate 28 is hidden underneath the escutcheon plate 30, which forms an upper portion of the escutcheon 22. The handle plate 28 moves with the handle 10 in a rotary motion. As the handle is operated, as seen in FIG. 3, the handle plate 28 is exposed from beneath the escutcheon plate 30.

Figure 8:
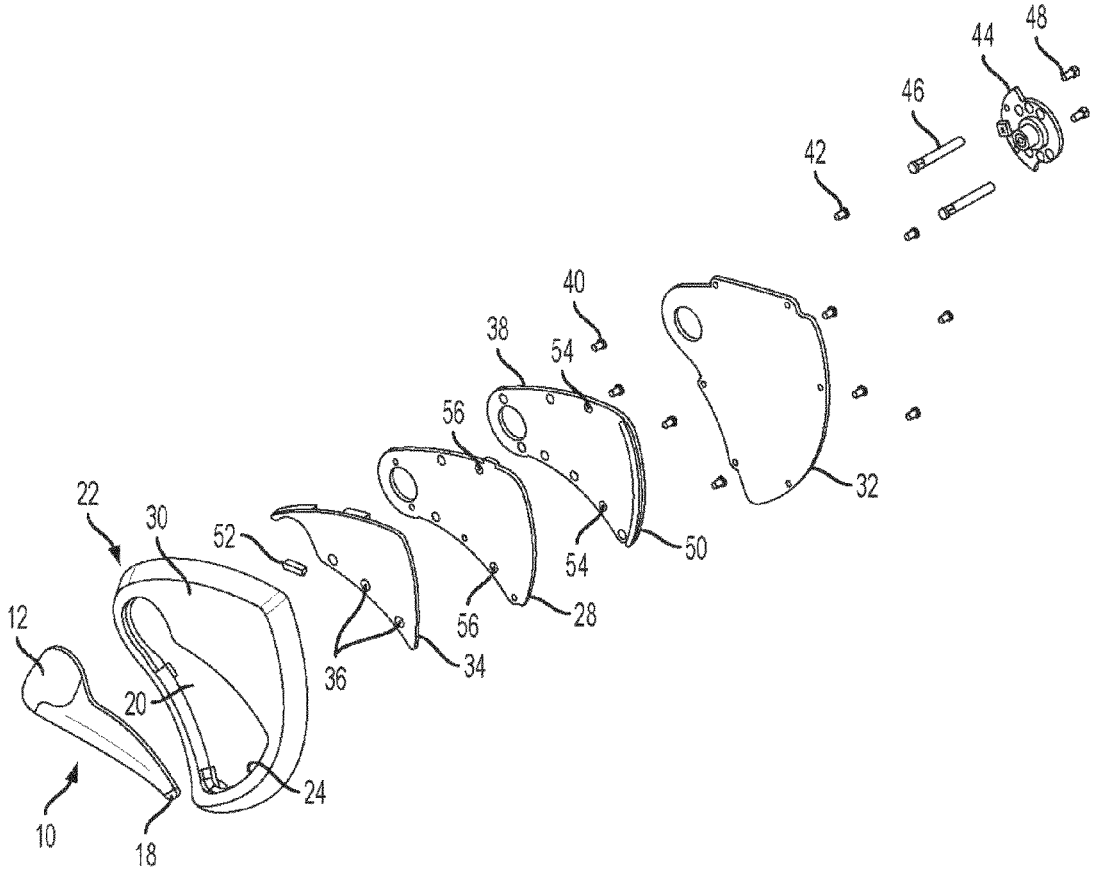
FIG. 8 is an exploded view of the anti-ligature handle seen in FIG. 1.

Referring to FIG. 8, the recess 20 is formed as an approximately triangular opening in the escutcheon 22. The back of the opening forming recess 20 is closed off with backing plate 32. The backing plate 32 and escutcheon 22 are fixed relative to the door surface and to each other.

The escutcheon plate 30 which forms the upper surface of the escutcheon 22 is preferably provided with an anti-friction escutcheon liner 34 made of plastic. As will be described below, the opposite surface of the anti-friction escutcheon liner 34 is provided with ligature traps.

The anti-friction escutcheon liner 34 is provided with short studs 36 that project out from the anti-friction escutcheon liner surface to engage correspondingly shaped openings formed on the opposite side of the escutcheon plate 30. The studs 36 couple the liner 34 to the hidden surface of the escutcheon plate 30. The escutcheon 22, including the escutcheon plate 30, the anti-friction escutcheon liner 34 and the backing plate 32 from a stationary unit which is fixed relative to the door 16.

The back surface of the handle plate 28 is provided with an anti-friction handle liner 38, which is also preferably formed of a low friction plastic. The handle plate 28, the anti-friction handle liner 38 and the handle 10 form a moving unit and move together as the handle is rotated. The anti-friction handle liner 38 and the handle plate 28 are tightly attached to the back side of the handle 10 with screws 40.

The escutcheon 22, handle plate 28 and backing plate are all preferably made of stainless steel, although other materials may be used. It can be seen that this construction makes an alternating layered structure of stainless escutcheon plate 30, plastic anti-friction escutcheon liner 34, stainless handle plate 28, anti-friction handle liner 38 followed by stainless backing plate 32. This alternating stainless steel plastic design provides for low friction, great strength and silent operation characteristic of high quality products.

The backing plate 32 is attached to the escutcheon 22 with screws 42. A bushing 44 attaches to the door and long studs 46 pass through the lock and cooperate with screws 48 for final mounting.

The lower edge of the anti-friction handle liner 38 is provided with a raised guide 50 formed as a ridge along the curved edge thereof. The curvature of the ridge matches the curvature of lower edge 24 of the recess 20 in the escutcheon 22. The raised guide enters and slidingly engages a corresponding guide track 58 (see FIG. 11) formed by the escutcheon 22 behind the lower edge 24 of the recess 20.

The raised guide 50 may be formed as part of the plastic anti-friction handle liner 38 or as part of the handle plate 28. The anti-friction handle liner 38 is provided with studs 54 around its perimeter which engage matching holes 56 in the handle plate 38. The short studs 54 and matching holes 56 lock the anti-friction handle liner 38 to the handle plate so that they move together as the handle 10 is rotated.

The handle 10 is typically biased upwards to the closed position by springs located in the lock mechanism. A resilient bumper 52 is provided in the escutcheon which acts to silently stop the upward return motion of the handle when the handle is released.

Figure 2:
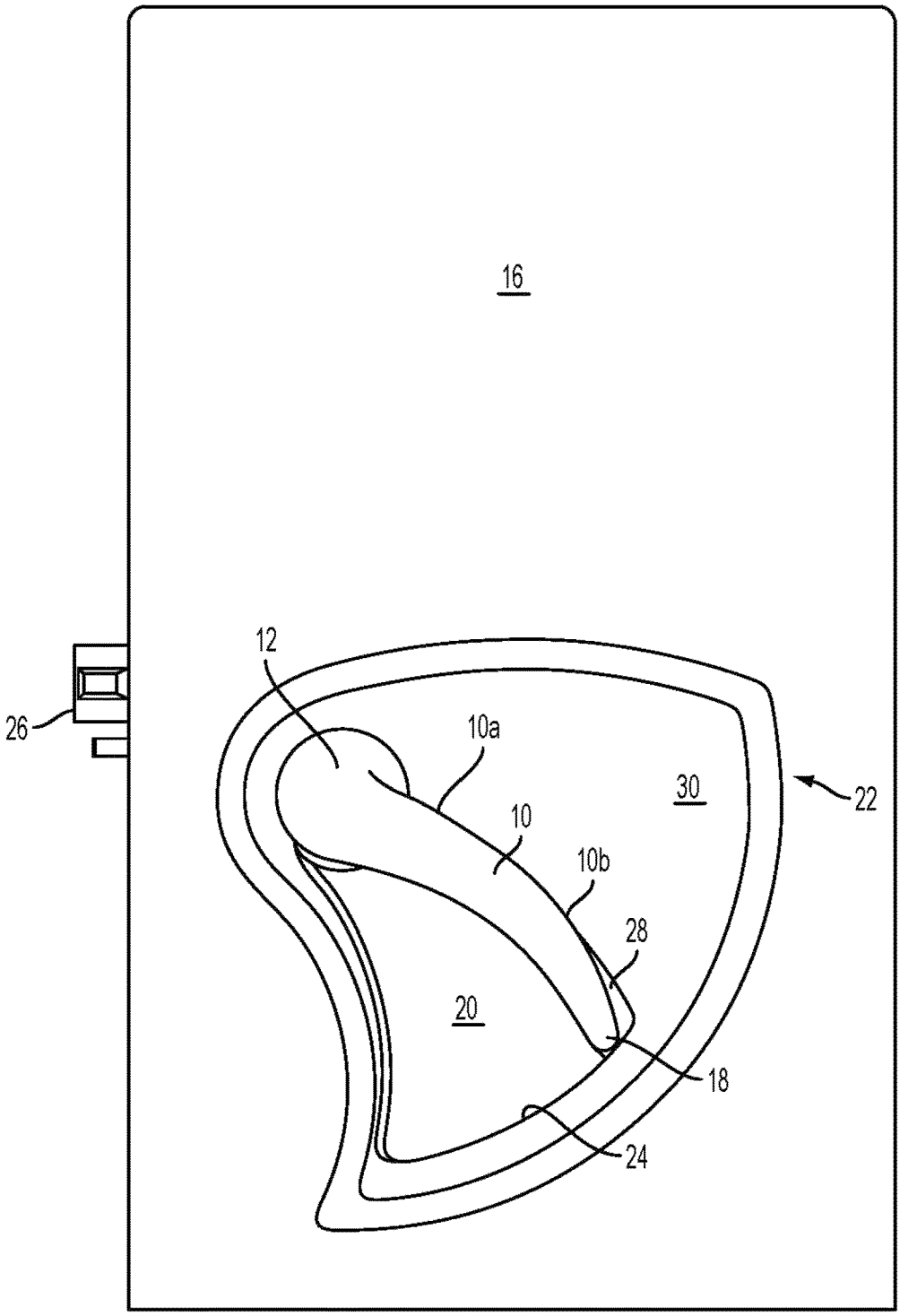
FIG. 2 is a front elevational view of the anti-ligature handle for a lock seen in FIG. 1.

FIG. 1 is a perspective view. FIG. 2 is an elevational view that better depicts the appearance of the handle. The handle is smoothly curved down to eliminate any hanging points. The curvature of the handle 10 is such that a users fingers may be placed up and over the top edge 10*a*, 10*b* and slightly behind the handle to provide a grip on the handle for pulling the handle and so that the handle may easily be operated.

The space behind the upper edge 10*a*, 10*b* of the handle forms a downwardly curved groove or channel which is not open. This prevents attachment of a ligature behind the handle 10. In FIG. 2 a small portion of the handle plate 28 can be seen near the lower end 18 of the handle 10. In FIG. 1 it can be seen that there is a small curved or arcuate opening along the lower curved edge 24 of the recess 20. The handle plate 28 slides into this curved opening as the handle is operated.

The raised guide 50 slides inside the escutcheon just inside the curved edge 24. The thickness of the raised guide 50 is greater than the size of the curved opening along 24. This traps the raised guide 50 inside the lower edge 24 of the escutcheon and prevents ligatures from entering there.

Figure 4:
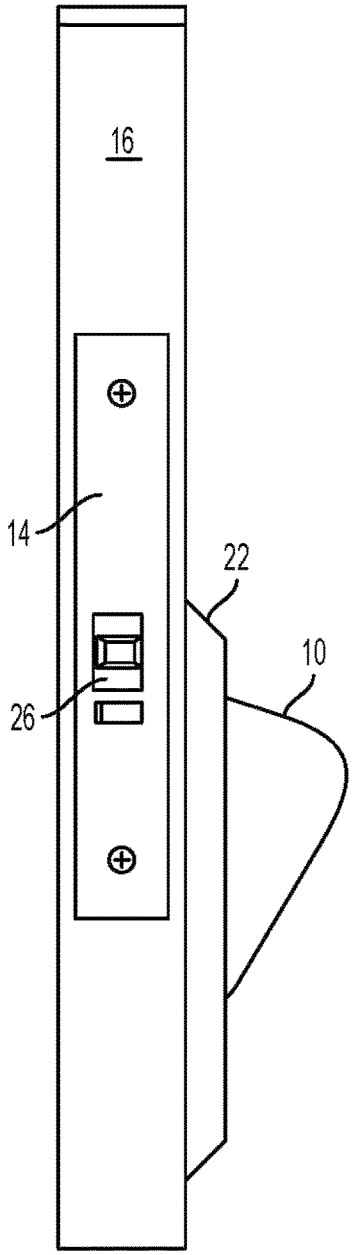
FIG. 4 is a right side elevational view of the anti-ligature handle for a lock seen in FIG. 1.
Figure 5:
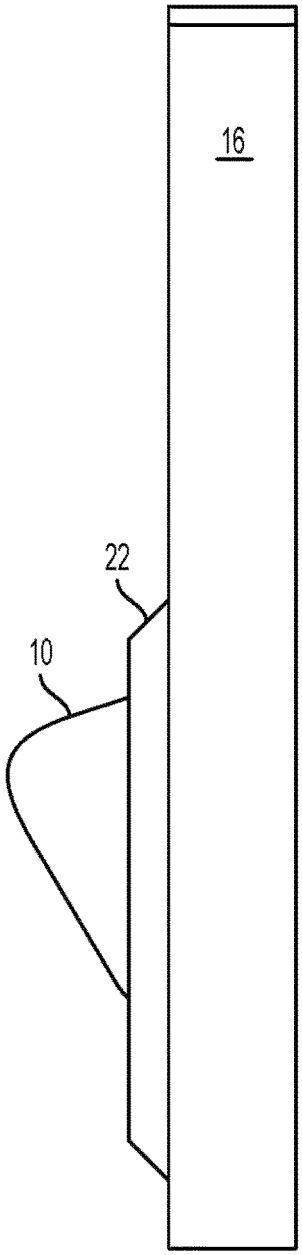
FIG. 5 is a left side elevational view of the anti-ligature handle for a lock seen in FIG. 1.
Figure 6:
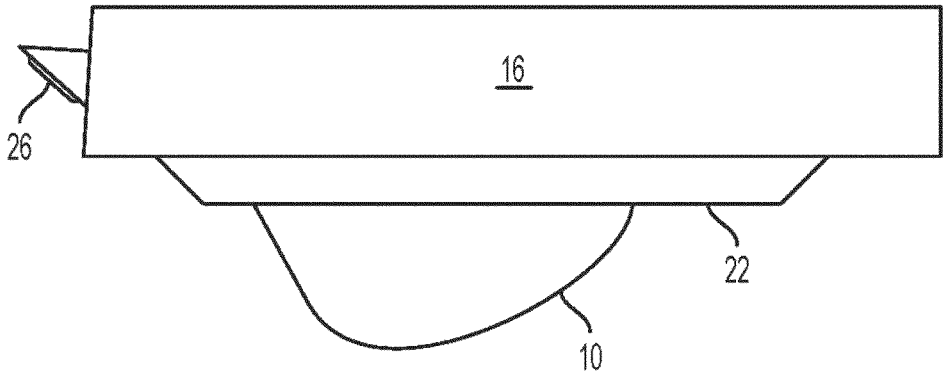
FIG. 6 is a top plan view of the anti-ligature handle for a lock seen in FIG. 1.
Figure 7:
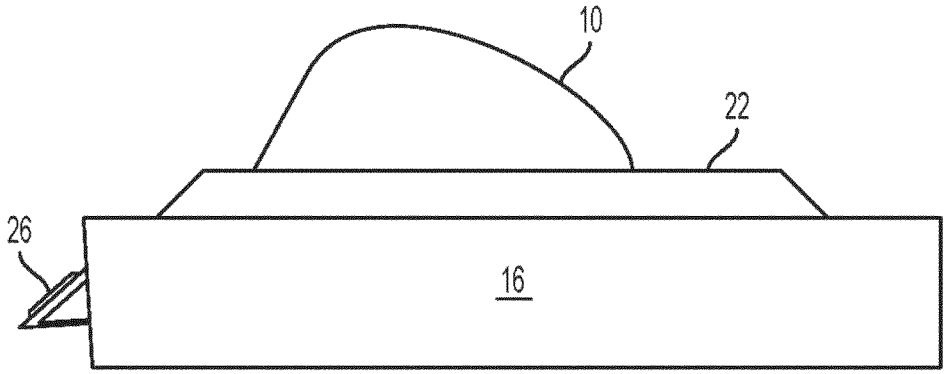
FIG. 7 is a bottom view of the anti-ligature handle for a lock seen in FIG. 1.

As can also be clearly seen in the side elevational views of FIGS. 4 and 5 and the top and bottom views of FIGS. 6 and 7, the handle is smoothly curved along all directions. There are substantially no right angles or projections or any hanging points that would allow attachment of a ligature.

Figure 9:
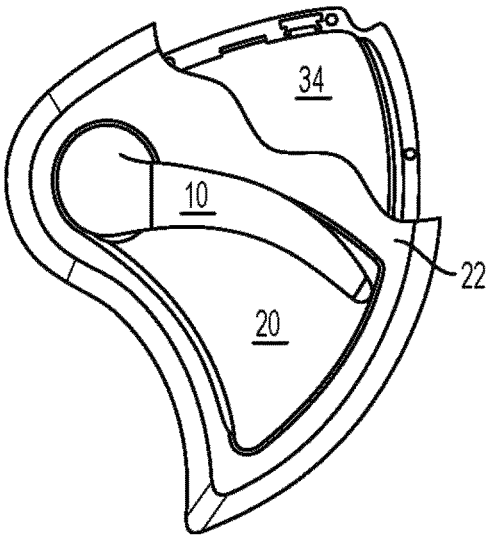
FIG. 9-12 are cut-away views of the anti-ligature handle seen in FIG. 1.

Referring to FIG. 9 it can be seen that the upper corner of the escutcheon 22 has been partially cut away to show the escutcheon liner 34. The handle is shown in the upward position corresponding to a closed lock position with the latchbolt extended.

Figure 10:
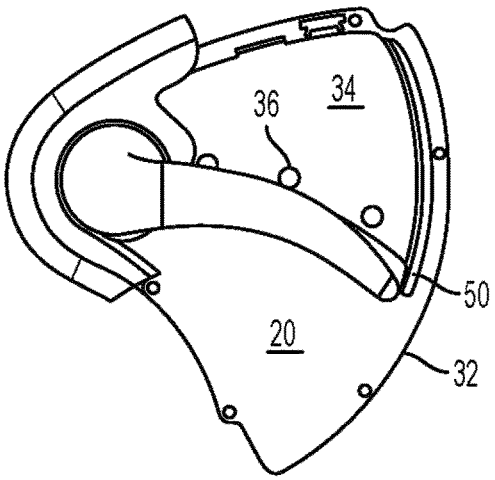

In FIG. 10 The lower half of the escutcheon has also been cut away and an additional part of the upper portion. This shows how the studs 36 molded into the surface of the plastic anti-friction escutcheon liner 36 engage corresponding blind holes in the back side of the upper portion of the escutcheon 22 that has been cut away from FIG. 10 in the region immediately above the handle 10.

It can also be seen in FIG. 10 that the recessed area 20 of the escutcheon is formed by a triangular perimeter of the escutcheon 22 and the lower surface of the backing plate 32. As seen in FIG. 8, the handle plate 28 is attached to the handle and carries the anti-friction handle liner 38 on its back surface. The anti-friction handle liner 38 sweeps across the surface of recess 20 as the handle is operated. The anti-friction handle liner 38 reduces friction between the handle plate and the backing plate.

The front surface of the handle plate 28 (which is partially exposed in FIG. 12) rides against a ridged back surface of the anti-friction escutcheon liner 34. The ridged surface is formed by multiple ligature traps 60 in the form of offset parallel rows of adjacent inverted V shaped ridges, which can be seen best in FIG. 11.

Figure 11:
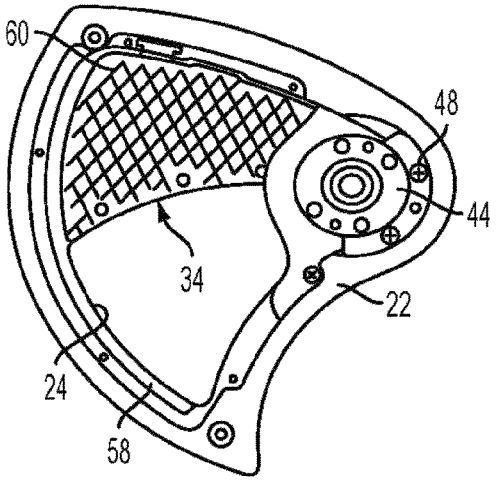

FIG. 11 is a back elevational view where the backing plate, anti-friction handle liner and handle plate have all been removed. This shows the multiple ligature traps 60. Each ligature trap is formed as an inverted V-shaped ridge separated from the adjacent ligature trap by a small gap. Other shapes that provide a dead end, such as inverted "U" shapes or "w" shapes and the like may also be used. Referring to FIG. 11, the upper row of ligature traps 60 includes six ligature traps. The row below that includes ten ligature traps and the lower row is offset relative to the upper row of six so that the gaps between each ligature trap in the lower row are under the inverted V of the upper row.

The guide track 58 can be seen in the back view of FIG. 11. The guide track 58 is curved and receives the curved raised guide 50 formed along the edge of the anti-friction handle liner (see FIG. 12).

Figure 12:
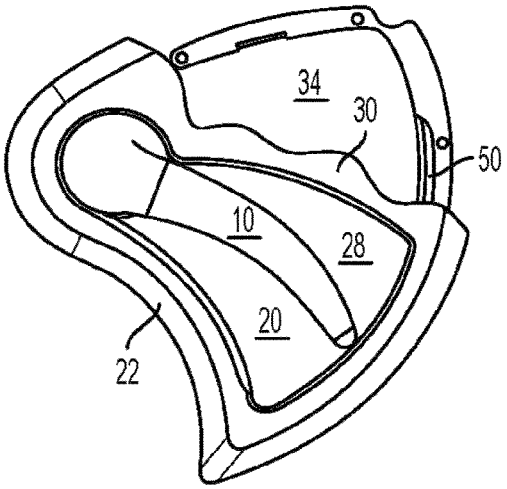

Referring also to FIG. 12, it can be seen that any attempt to insert a small diameter ligature, such as dental floss around the handle 10 requires that the ligature be inserted up behind the escutcheon plate portion 30 between the escutcheon plate portion 30 and the handle plate 28. As the ligature is inserted, it will be guided into one of the many ligature traps 60 in the lowest rows of the arrayed ligature traps.

If by chance the ligature passes through the small gap between adjacent ligature traps, it will project into the dead end formed by the inverted V of the ligature trap in the offset row immediately above the gap. It will be seen that it is not possible to pass ligatures in the upwards direction around the handle. The rows of ligature traps act as a one-way barrier to prevent upward insertion of any ligature even if small diameter or stiff ligatures are used.

The ligature traps are shallow ridges and the surfaces of those ridges ride against and wipe the smooth surface of the handle plate 28 as the handle 10 is operated. This wiping action also wipes off any dirt or debris from the surface of the handle plate 28 as the handle returns. The dirt is wiped into the inverted V and subsequently falls out by the force of gravity.

In the event that any dirt passes into a gap, it will be swept into the inverted V in the next row due to the offset row construction. Any liquid or dirt can eventually work its way down from the upper rows of the ligature traps as the edges of the upper rows funnel liquid or debris into the gaps in those rows, and the inverted V shapes in the subsequent rows then act to move the liquid or contaminants laterally to the gap in that row.

In the preferred design, the V-shaped ligature traps are separate and have small gaps between each trap. Alternatively, the ligature traps may be formed as a continuous horizontal zigzag, but by forming them as individually spaced elements with a small gap between each element, dirt, dust, water and other contaminants are prevented from accumulating on the upper side of the traps.

Figure 13:
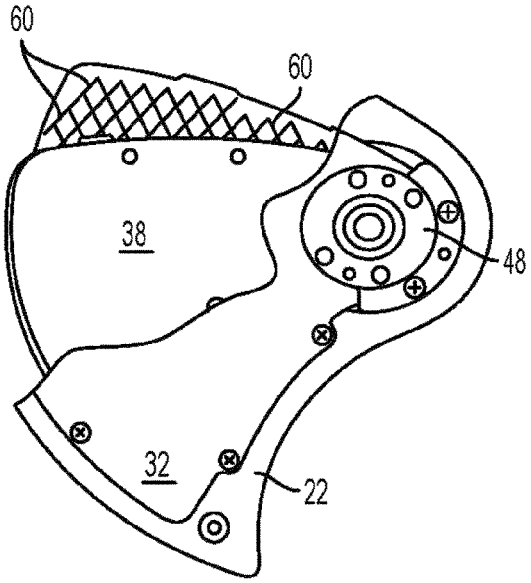
FIG. 13 is a back elevational view corresponding to FIGS. 3 and 12 where the handle is partially operated. The backing plate has been partially cut away to show the handle liner moving with the plate and partially exposing the ligature traps on the exposed surface of the escutcheon liner.

FIG. 13 shows a back elevational view corresponding to FIGS. 3 and 12 where the handle is partially operated. The backing plate has been partially cut away to show the anti-friction handle liner 38 moving with the handle plate 28 and partially exposing the ligature traps 60 on the exposed surface of the escutcheon liner 34.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An anti-ligature handle and escutcheon mechanism mountable on a door for operating a lock mounted on the door, the anti-ligature handle and escutcheon mechanism comprising:

a handle rotatable between an open and a closed position, the handle being shaped as a lever handle with a smoothly curved outer surface to prevent the attachment of a ligature thereto, the handle rotating about a first end of the lever handle shape to operate the lock;

an escutcheon having an escutcheon plate oriented parallel to the door when the anti-ligature handle and escutcheon mechanism is mounted on the door; and a handle plate oriented parallel to the door when the anti-ligature handle and escutcheon mechanism is mounted on the door, the handle being securely attached to the handle plate to prevent ligatures from being inserted between the handle and the handle plate, the handle plate moving with the handle and being exposed only above the handle as the handle is rotated toward the open position to operate the lock and the handle plate moving behind the escutcheon plate between the escutcheon plate and the door as the handle is rotated to the closed position.

2. The anti-ligature handle and escutcheon mechanism according to claim 1 further including an escutcheon liner attached to the escutcheon plate and positioned between the escutcheon plate and the handle plate.

3. The anti-ligature handle and escutcheon mechanism according to claim 2 wherein the escutcheon liner is formed of plastic and reduces friction between the escutcheon plate and the handle plate when the handle is rotated.

4. An anti-ligature handle and escutcheon mechanism mountable on a door for operating a lock mounted on the door, the anti-ligature handle and escutcheon mechanism comprising:

a handle rotatable between an open and a closed position, the handle being shaped as a lever handle with a smoothly curved outer surface to prevent the attachment of a ligature thereto, the handle rotating about a first end of the lever handle shape to operate the lock;

an escutcheon having an escutcheon plate oriented parallel to the door when the anti-ligature handle and escutcheon mechanism is mounted on the door;

a handle plate oriented parallel to the door when the anti-ligature handle and escutcheon mechanism is mounted on the door, the handle being securely attached to the handle plate to prevent ligatures from being inserted between the handle and the handle plate, the handle plate moving with the handle as the handle is rotated toward the open position to operate the lock and the handle plate moving behind the escutcheon plate between the escutcheon plate and the door as the handle is rotated to the closed position; and an escutcheon liner attached to the escutcheon plate and positioned between the escutcheon plate and the handle plate, the escutcheon liner including at least one ligature trap formed on a surface thereof between the escutcheon liner and the handle plate, the at least one ligature trap acting to prevent ligatures from being inserted between the escutcheon plate and the handle plate.

5. The anti-ligature handle and escutcheon mechanism according to claim 4 wherein the at least one ligature trap is formed as a dead end shape having an open end to receive a ligature and a closed end to prevent the passage of a ligature, the dead end shape being oriented on the escutcheon liner to direct ligatures inserted between the handle plate and the escutcheon plate into the open end of the dead end shape.

6. The anti-ligature handle and escutcheon mechanism according to claim 5 wherein the dead end shape is a "V" shape or a "U" shape.

7. The anti-ligature handle and escutcheon mechanism according to claim 5 further including a plurality of additional adjacent ligature traps, each additional ligature trap having a dead end shape with an open end to receive a ligature and a closed end to prevent the passage of a ligature.

8. The anti-ligature handle and escutcheon mechanism according to claim 7 wherein the plurality of additional adjacent dead end ligature traps are formed in at least two rows, the at least two rows including a first row having adjacent dead end ligature traps and a second row, offset from the first row, the second row oriented to position the open ends of the dead end shapes of the second row to receive ligatures extending between dead end ligature traps in the first row.

9. The anti-ligature handle and escutcheon mechanism according to claim 8 wherein the plurality of additional adjacent dead end ligature traps each have a "V" shape or a "U" shape.

10. The anti-ligature handle and escutcheon mechanism according to claim 9 wherein the plurality of additional adjacent dead end ligature traps are oriented with the open ends of the traps pointing approximately down when the anti-ligature handle and escutcheon mechanism is mounted on the door to prevent debris from accumulating in the ligature traps.

11. The anti-ligature handle and escutcheon mechanism according to claim 4 further including a plurality of additional adjacent ligature traps and wherein the additional ligature traps are formed as small ridges set in offset rows with a low height, the moving handle plate being in contact with and riding against the additional ligature traps.

12. The anti-ligature handle and escutcheon mechanism according to claim 1 wherein the anti-ligature handle is smoothly curved and shaped to allow a user to place fingers behind an upper edge of the handle and between the upper edge of the handle and the handle plate, but without providing an opening behind the handle.

13. The anti-ligature handle and escutcheon mechanism according to claim 1 wherein the escutcheon surrounds the handle.

14. The anti-ligature handle and escutcheon mechanism according to claim 13 wherein the escutcheon defines a recessed area and the handle pivots in the recessed area.

15. The anti-ligature handle and escutcheon mechanism according to claim 14 wherein the recessed area is approximately triangular in shape and includes an arcuate edge along at least one side of the approximately triangular recessed area.

16. The anti-ligature handle and escutcheon mechanism according to claim 14 wherein the recessed area is approximately triangular in shape, and the first end of the handle pivots near a first corner of the approximately triangular recessed area and a second end of the handle moves from near a second corner of the approximately triangular recessed area to near a third corner of the approximately triangular recessed area as the handle is rotated.

17. The anti-ligature handle and escutcheon mechanism according to claim 1 wherein the handle further includes a second end and the handle plate extends beyond the second end of the handle and passes underneath a portion of the escutcheon as the handle is rotated to operate the lock.

18. The anti-ligature handle and escutcheon mechanism according to claim 17 further comprising a handle liner attached to the handle plate, the handle liner including a guide, the escutcheon includes a guide track and the guide of the handle liner slides along the guide track of the escutcheon as the handle is rotated to operate the lock.

19. The anti-ligature handle and escutcheon mechanism according to claim 1 wherein the escutcheon is smoothly curved and provides no projections or hanging points.

20. The anti-ligature handle and escutcheon mechanism according to claim 2 further including a backing plate mountable to the door and wherein the escutcheon, escutcheon plate, and escutcheon liner are fixed relative to the backing plate.

21. The anti-ligature handle and escutcheon mechanism according to claim 20 further including a handle liner attached to the handle plate, the handle liner and the escutcheon liner being formed of plastic, the escutcheon liner being positioned between the handle plate and the escutcheon plate, and the handle liner being positioned between the handle plate and the backing plate.

* * * * *